United States Patent [19]

Watanabe et al.

[11] 4,324,449

[45] Apr. 13, 1982

[54] NOISE REDUCTION CONNECTORS

[75] Inventors: Mitsugu Watanabe, Numazu; Tomoyuki Hirano, Cotenba, both of Japan

[73] Assignee: Yazaki Corporation, Tokyo, Japan

[21] Appl. No.: 217,492

[22] Filed: Dec. 17, 1980

Related U.S. Application Data

[63] Continuation of Ser. No. 96,073, Nov. 20, 1979, abandoned, which is a continuation of Ser. No. 870,572, Jan. 18, 1978, abandoned.

[30] Foreign Application Priority Data

Jan. 28, 1977 [JP] Japan ..... 52-7658

[51] Int. Cl.[3] ..... H01R 13/62; H01R 3/00

[52] U.S. Cl. ..... 339/91 R; 339/93 R; 339/278 D

[58] Field of Search ..... 339/91 R, 93 R, 278 D, 339/278 C, 10, 196 A; 181/207, 202, 204, 206, 245, 294, 295; 29/527.2; 285/48, 49; 264/309, 272; 156/49; 427/202, 203, 206, 302

[56] References Cited

U.S. PATENT DOCUMENTS

| | | | |
|---|---|---|---|
| 2,004,610 | 6/1935 | Jones | 339/93 R |
| 2,399,899 | 5/1946 | Tinnerman | 339/278 X |
| 3,443,307 | 5/1969 | Werner et al. | 29/527.2 |
| 3,916,049 | 10/1975 | Kingsbury | 181/207 X |
| 3,933,406 | 1/1976 | Cameron | 339/91 R |

OTHER PUBLICATIONS

Japanese Patent Pub. No. 51-127141, Nitto Electric Works Ltd.

Japanese Patent Pub. No. 45-14677, Tetsusabura Sakamoto.

Japanese Utility Model Pub. 52-57602, Yasuda Metallic Products Co. Ltd.

Japanese Patent Pub. No. 47-34361, Fumakiller Co. Ltd.

*Primary Examiner*—John McQuade

*Assistant Examiner*—John S. Brown

*Attorney, Agent, or Firm*—Blanchard, Flynn, Thiel, Boutell & Tanis

[57] ABSTRACT

Plastic wiring connectors used in an automobile electric circuit often produce noise to the discomfort of the passengers. Connectors of this invention are coated with a suitable fiber strand material on their surfaces etc., considerably reducing such noise.

9 Claims, 15 Drawing Figures

NOISE REDUCTION CONNECTORS

This is a continuation of application Ser. No. 96,073, filed Nov. 20, 1979, and now abandoned, which is a continuation of application Ser. No. 870,572, filed Jan. 18, 1978 and now abandoned.

BACKGROUND OF THE INVENTION

The present invention relates to noise reduction connector and more particularly to a new type of connector used for wiring in the electrical circuits of automobiles, which connectors are free from noise attributable to its vibration on some nearby structure of the vehicle body.

Nowadays, the performances of automobiles have been remarkably improved, and, public attention is now given to improvements in car passenger comfort. Under such circumstances, noise caused by the vibration or operation of the automobile appliances gives a bad impression to passengers. The source of such noise can be plastic components which are widely used in automobile construction; those plastic appliances vibrate against the body of the vehicle. Among others, connectors made of a hard plastic material such as nylon, polypropylene or acrylonitrile-butadiene-styrene are now extensively used in the wiring or for wire harnesses in the electric circuits of automobiles, and they can be noise sources. This is particularly the case with connectors arranged behind the dashboard, and in or near the passenger compartment. Also, where the engagement of male and female connector members is too loose, it affects the electrical reliability between the male and female terminals.

SUMMARY OF THE INVENTION

It is an object of the present invention to provide a pair of connectors which prevents generation of noises in the vehicle.

It is another object of the present invention to provide a pair of connectors which ensures a firm electrical connection between a male terminal and a female terminal.

The above objects are achieved by a new type of connector according to the present invention without increasing the size and/or weight of connectors.

In one aspect of the present invention, there is provided a pair of noise reduction connectors the surfaces of which are coated with a suitable fiber material on at least part thereof.

A pair of noise reduction connectors are manufactured by a method comprising the steps of blowing a cloud of omnidirectional free moving pulverized fiber pieces in between two electrodes applied with a predetermined voltage; moving between said electrodes connectors applied with adhesive on at least part of their surfaces to receive some fiber pieces for forming a coating thereon; and drying the adhesive layers on said surfaces to fix said fiber coating thereon.

BRIEF DESCRIPTION OF THE DRAWINGS

There and further objects and advantages of the present invention will become more apparent upon reference to the following specification, appended claims and drawings wherein:

DETAILED DESCRIPTION OF THE PREFERRED EMBODIMENTS

Figure 1:
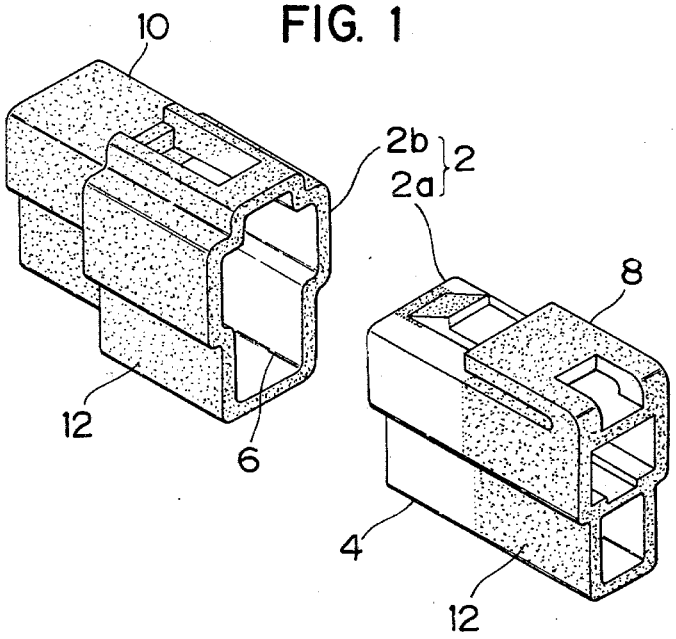
FIG. 1 is a perspective view of a pair of connectors coated with fibers on their exposed surfaces when in engagement.

Referring to FIG. 1, numeral 2 designates connectors. Said connectors are usually used as a pair; a male connector member 2*a* and a female connector member 2*b*. An engaging portion 4 of said male connector member 2*a* and an engaging portion 6 of said female connector member 2*b* are designed to engage each other. A non-engaging portion 8 of male member 2*a* and a non-engaging portion 10 of female member 2*b* are coated with fibers 12.

Figure 2:
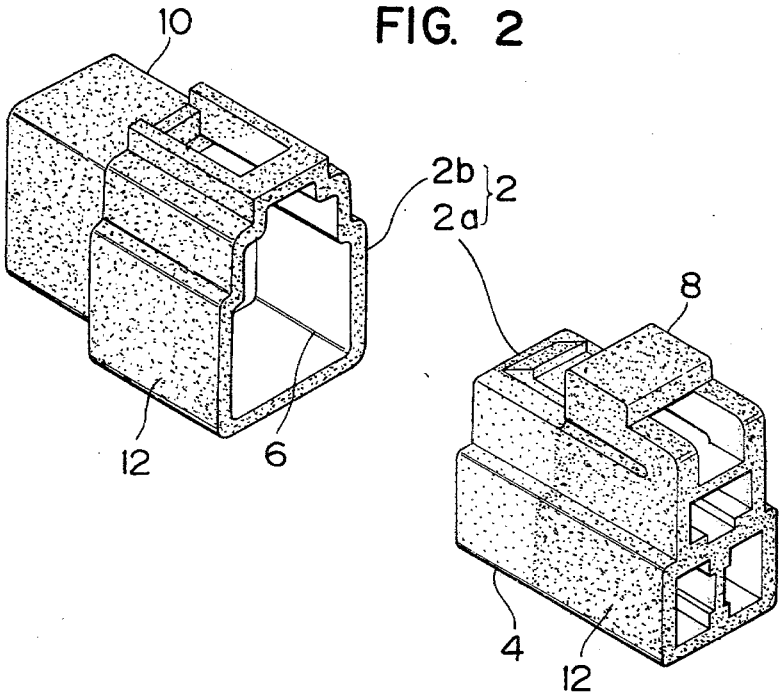
FIG. 2 is a perspective view of another pair of connectors coated with fiber pieces first on their exposed surfaces under a connected condition and then on an engaging portion of the male connector member under a disconnected condition.

Referring to FIG. 2, the engaging portion 4 of male member 2*a* is also coated with fibers 12 but said fibers coating 12 a little thinner than that on non-engaging portion 8. Engaging portion 6 of female member 2*b* is not coated. It is also preferred to coat with different colour fibers male member 2*a* and female member 2*b* to distinguish between male and female members. Fiber coating need not necessarily be done on the whole surface of each portion. Depending on the mode of use, said coating may be only on part of the surface. Coating fibers may be selected from nylon, rayon or cotton. Materials of said connectors are selected from paper, polypropylene, nylon, glass, metal, urethane, rubber foam, etc.

Figure 3:
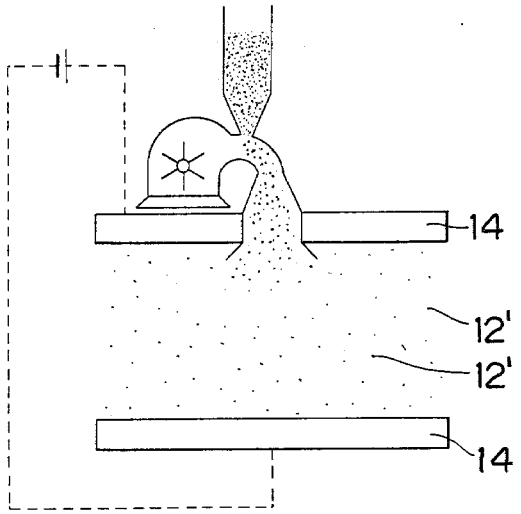
FIG. 3 shows a first essential step of the method in which pulverized fiber pieces are blown in between two electrodes applied with a predetermined voltage such that a cloud of omnidirectional free moving fibers is formed.
Figure 4:
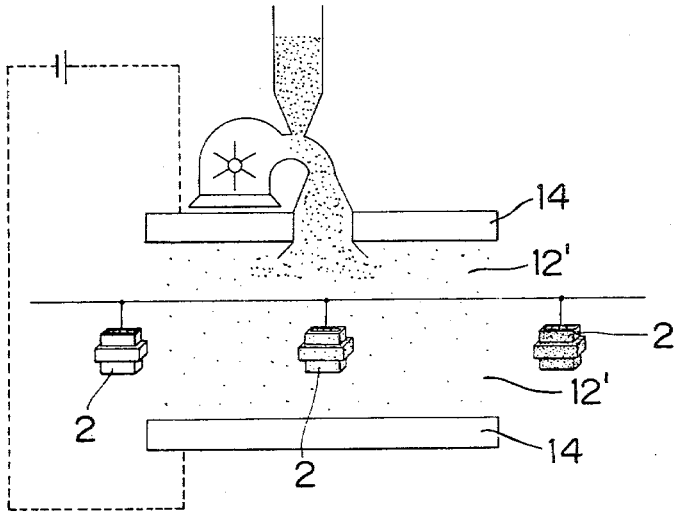
FIG. 4 shows a second essential step of the method in which connectors applied with adhesive on their surfaces are moved through said cloud of fiber pieces.
Figure 5:
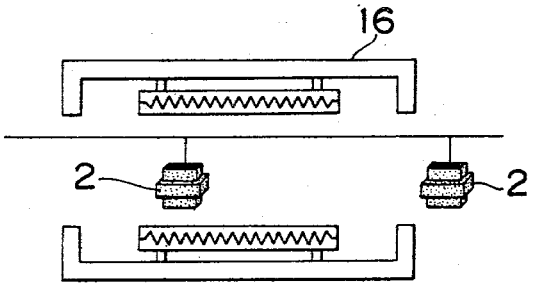
FIG. 5 shows a third essential step of the method of the present invention, in which fiber coated connectors are subjected to a drying treatment.

Next, the method of preparing the said noise reducing connectors is explained referring to FIGS. 3, 4 and 5. In the first step, pulverized fiber pieces 12' forming a cloud are blown in between a pair of electrode plates 14 to which is applied a potential difference of 40,000 volts as shown in FIG. 3. Fiber includes nylon, rayon, or cotton and its strand length is preferably 0.3 to 3 mm. Said electrode plates are spaced from each other by about 20 to 30 cm. These blown fiber pieces are attracted, due to their dielectric polarization, to the respective electrode plates. For example, if some fiber pieces are attracted onto the positively charged electrode plate, they are imparted with the same charge. As a result, said fiber pieces move from the positive electrode plate into the air and are attracted to the negatively charged electrode plate. Upon landing on the negative electrode plate, said fiber pieces are imparted with negative charge, thus moving from the negative electrode plate into the air and attracted to the positively charged electrode plate. In this way, fiber pieces form an omnidirectional free moving cloud between the two electrode plates.

In the second step, a pair of connectors 2 consisting of male and female members which are connected together is moved through said fiber cloud as shown in FIG. 4. The connectors may be passed through the fiber cloud in the connected or dis-connected condition, individually or collectively, so as to coat the selected part in a selected colour. These male and female members are applied with adhesive beforehand on their surfaces to be coated. As the connector passes through the fiber cloud, fibers adhere to the adhesive layer on the surface of connector members, thus forming a coating thereon. In this manner, the connectors can be selectively coated with fibers. In either case, the fiber length can be optionally elected from the range of 0.3 to 3 mm while fiber thickness can be in the range of 1.5 to 30 denier, considering the mass of connector material of other automobile appliances surrounding the connectors when in use. Where connectors 2 are moved through the fiber cloud in disconnected form, adhesive is applied, beforehand, on at least one of the engaging portions 4 and 6. In most cases, however, the engaging portion 4 of male connector member 2*a* is applied with adhesive. This procedure is designed to produce a connector pair which has very low noise as well as connectors which ensure definite connection for reducing poor function in the electric circuit. Fiber piece length of about 0.3 mm is sufficient for this purpose. The thus treated members may be connected to each other for additional treatment on their outer surfaces. When connectors 2 are moved through the fiber cloud 12' in the connected form, only the exposed surfaces are applied with adhesive. As a result, fibers are coated on said exposed surfaces during the travel of said connectors 2 through said fiber cloud 12'.

In the third step, connector member 2 coated with fibers on its surface are moved into a high temperature chamber 16 and subjected to heating therein for about 10 minutes at 80° to 100° C. as shown in FIG. 5. Alternatively they may be subjected to natural drying. As a result of the adhesive layer setting, fiber pieces are fixedly attached on the surface of connectors 2.

The foregoing steps can complete the treatment of connector members for noise reduction but they may be accompanied by the following steps if application of the adhesive on the engaging portions 4 and 6 of male and female members 2*a* and 2*b* had not been conducted as the second step.

In the fourth step, connected male and female members 2*a* and 2*b* are disconnected from each other. Then, at least one of their engaging portions 4 and 6 has adhesive applied. The adhesive layer may cover the entire or partial portion of engaging portions 4 or 6.

In the fifth step, pulverized fiber pieces having a length equal to or shorter than those used in the first step are blown in between said electrodes 14 as in FIG. 3. These fiber pieces are designed to be planted on at least one of the engaging portions 4 and 6 for filling the gap found between them due to loose engagement of male and female connectors. Therefore, fiber piece length is equal to or preferably shorter than that of fiber pieces used in the first step, being sufficient to fill the unnecessary gap.

In the sixth step, the connector with the engaging portion applied with adhesive in the fourth step is moved through fiber cloud 12'. As a result, some fiber pieces adhere to the selected engaging portion 4 or 6.

In the seventh step, said engaging portion having fiber pieces coated thereon is dried. Drying may be done by placing said coated conector member in the high temperature chamber and drying at a temperature of 80° to 100° C. for ten minutes or by natural drying.

The thus prepared noise reduction connectors are free from buzzing noise due to loose engagement of portions 4 and 6 of the respective male and female members.

The selectively coated fibers on the surface of the noise reducing connectors according to the present invention functions as a cushion to prevent noise. This advantage was verified by the following tests.

COMPARATIVE TEST I

Figure 6:
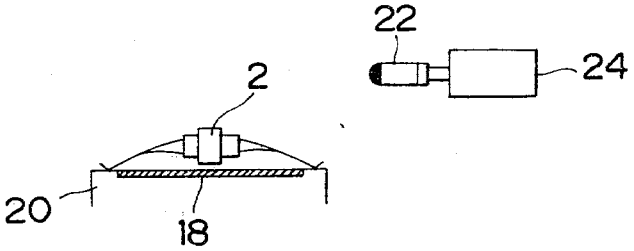
FIG. 6 is a diagramatic illustration of a vibration test conducted to compare the noise levels of the connectors of the present invention with those of the conventional connectors.

As shown in FIG. 6, a pair of connectors 2 was placed on the vibration steel plate 18 (0.8 mm in thickness) provided on the center portion of vibration table 20. Microphone 22 was set about 350 mm away from said connectors. Noise meter 24 was connected to microphone 22. The vibration table 20 was then started. The frequency was set to change from 20 to 200 Hz gradually during a period of one minute. The acceleration was 4.5 G. The test was conducted according to JIS 1601 for vibration testing of auto parts.

Tests were conducted four times as follows:

(1) The vibration table 20 was started without connectors thereon;

(2) A pair of conventional connectors was attached to the vibration plate 18 and then vibration table 20 was started;

(3) A pair of connectors coated with fibers with a length of 1.5 mm was attached to plate 18 and then table 20 was started; and (4) A pair of connectors coated with fibers with a length of 3.0 mm was attached to plate 18 and table 20 was started.

The dB noise level in each of the tests is shown in the following table.

| | Test No. | | | |
|---|---|---|---|---|
| Hz | (1) | (2) | (3) | (4) |
| 20 | 77 | 82 | 77.5 | 77.5 |
| 100 | 100 | 104 | 102 | 100 |
| 200 | 85 | 96 | 86 | 85 |

Figure 7:
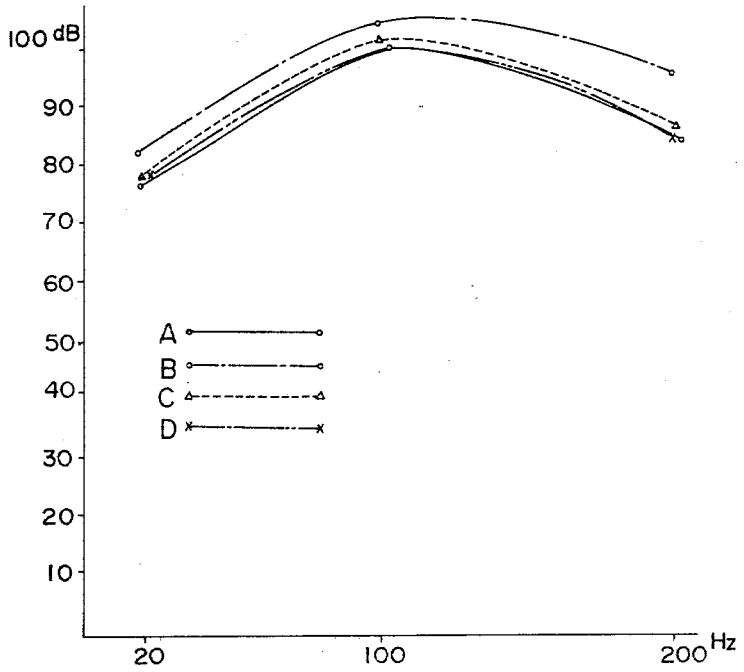
FIG. 7 is a graph comparing the results obtained from the vibration tests.

FIG. 7 shows the above results graphically, in which curve A corresponds to the result of test (1), curve B to test (2), curve C to test (3), and curve D to test (4).

From the foregoing, it is clearly recognized that connectors according to the present invention are remarkably instrumental in preventing noise caused by vibration of the vehicle body.

In addition, it is also observed that the conventional connectors generated a discomforting buzzing sound beyond the level of 100 Hz while the connector pairs used in tests (3) and (4) did not generate such a noise at all. Below the level of 100 Hz, a clattering sound was heard in test (2) but not in tests (3) and (4).

COMPARATIVE TEST II

Figure 8:
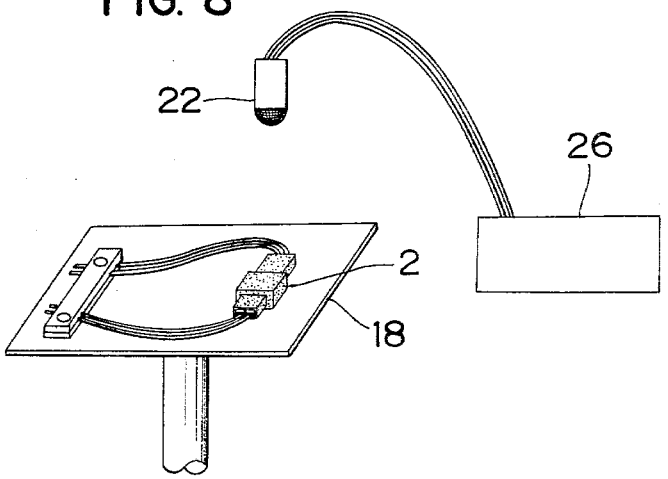
FIG. 8 is a perspective illustration of another vibration test conducted to compare the noise levels of the present noise reduction connectors and conventional connectors from 50 Hz to 12,500 Hz.

As shown in FIG. 8, a pair of connectors 2, the material of which is nylon 66, was placed on the vibration steel plate 18 (2 mm in thickness). The vibration test device was Model VS-3202 of International Mechanical Vibration Laboratory, Inc. Microphone 22 was set about 150 mm away from said connectors. Frequency analyzer 26 (TYPE SA-57 of Lyon Co., Ltd.) was connected to microphone 22. The vibration plate 18 was started at a frequency of 50 Hz. The acceleration was 4.5 G.

The noise generated by connectors 2 and vibration plate 18 when they hit each other was recorded via microphone 22 and the levels of noise at various frequencies obtained through analysis of the noise were indicated by frequency analyzer 26. FIGS. 9 to 15 compare the test results for the conventional connectors (designated as curve A) with those for the following samples (designated as curve B).

Figure 9:
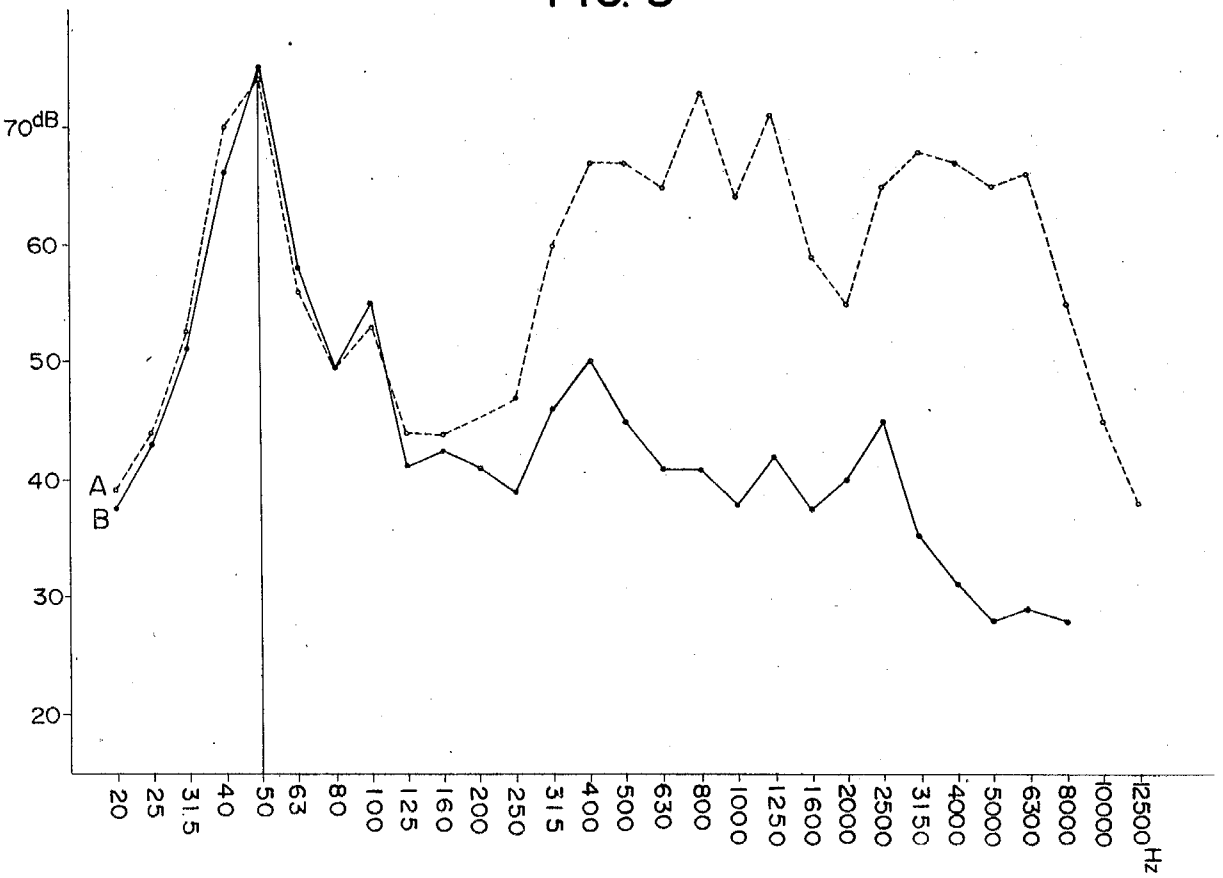
FIGS. 9 to 15 are graphs showing the results of the above test.
Figure 10:
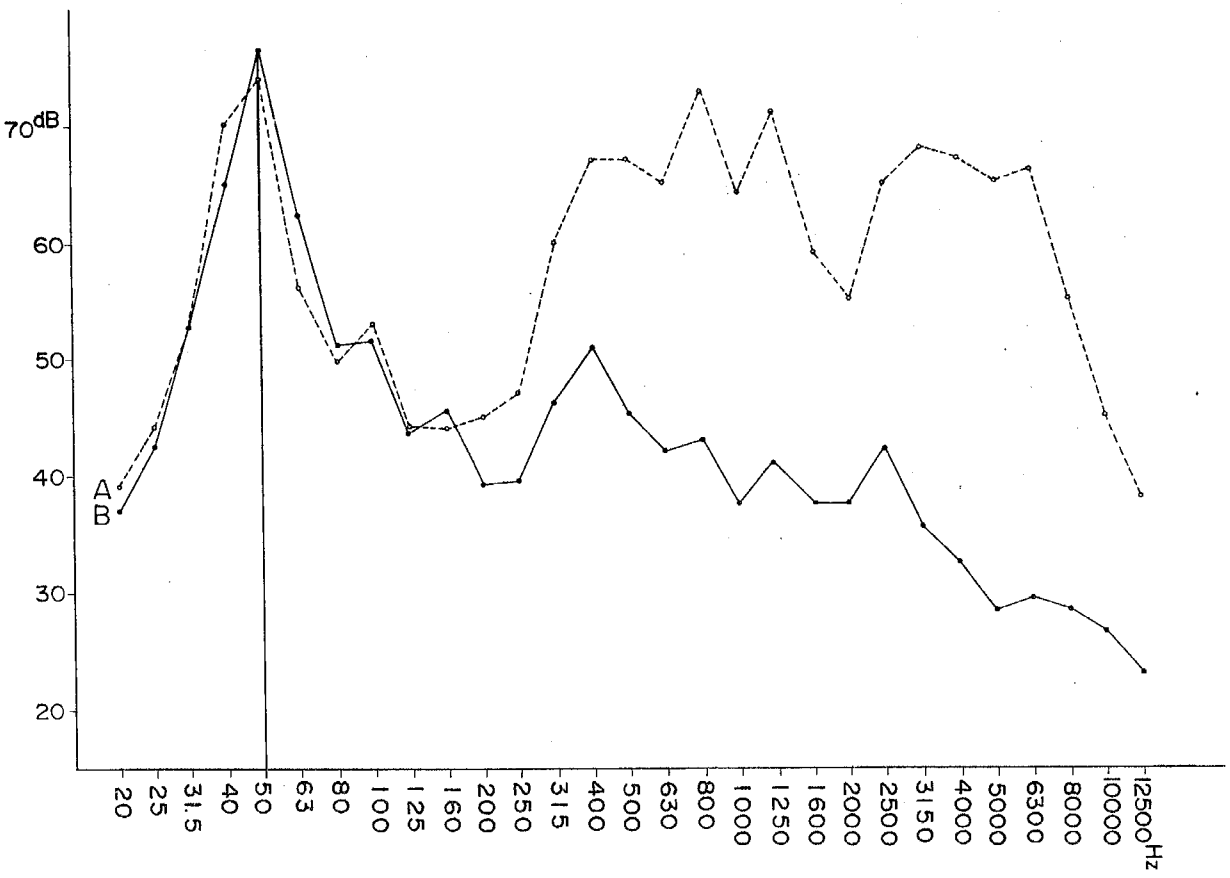
Figure 11:
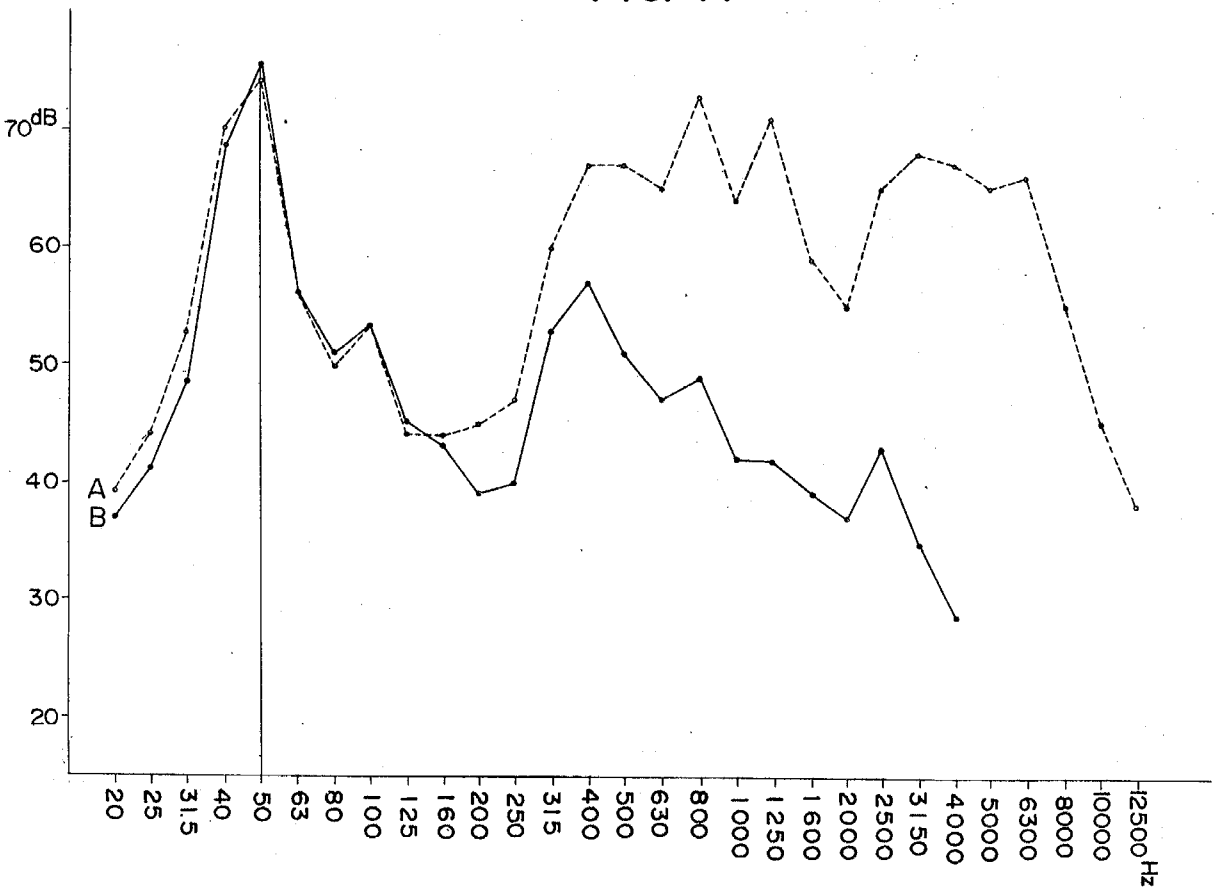
Figure 12:
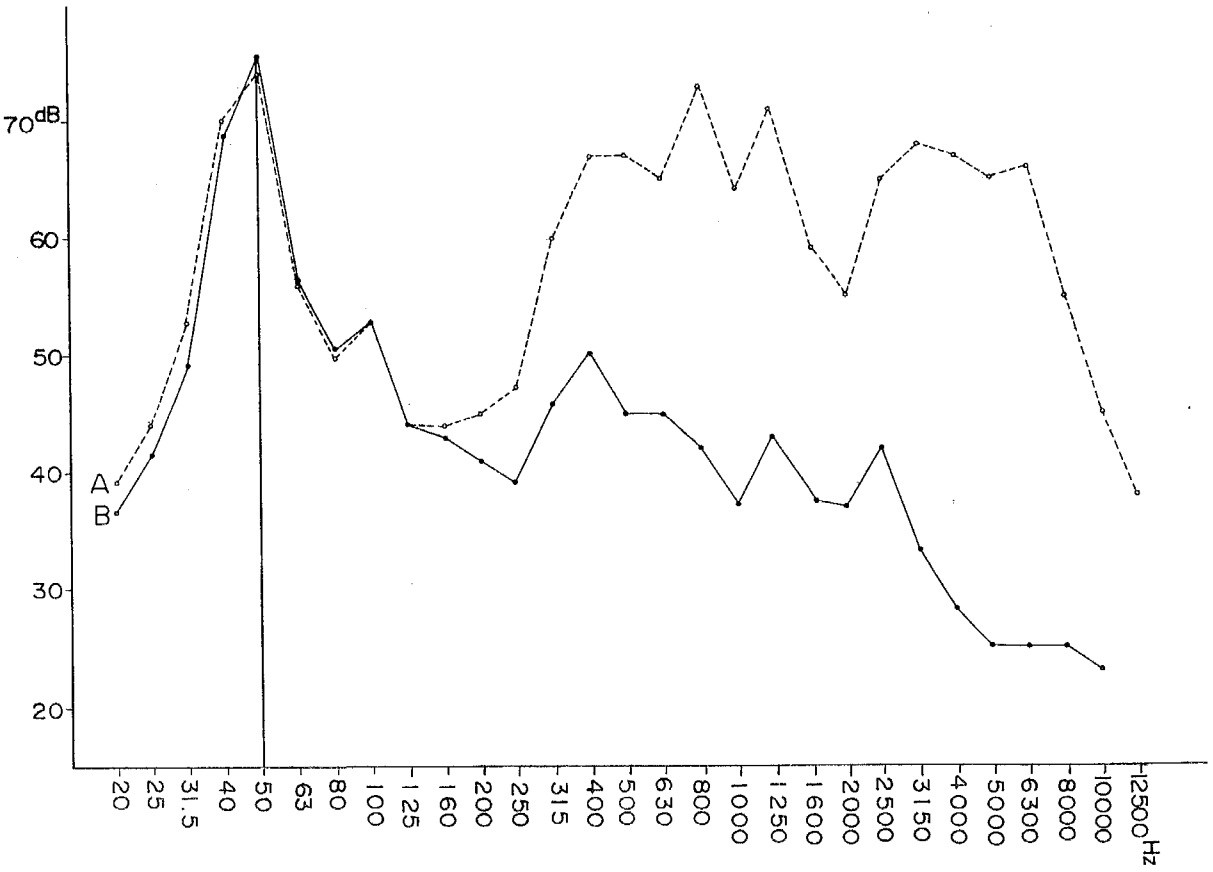
Figure 13:
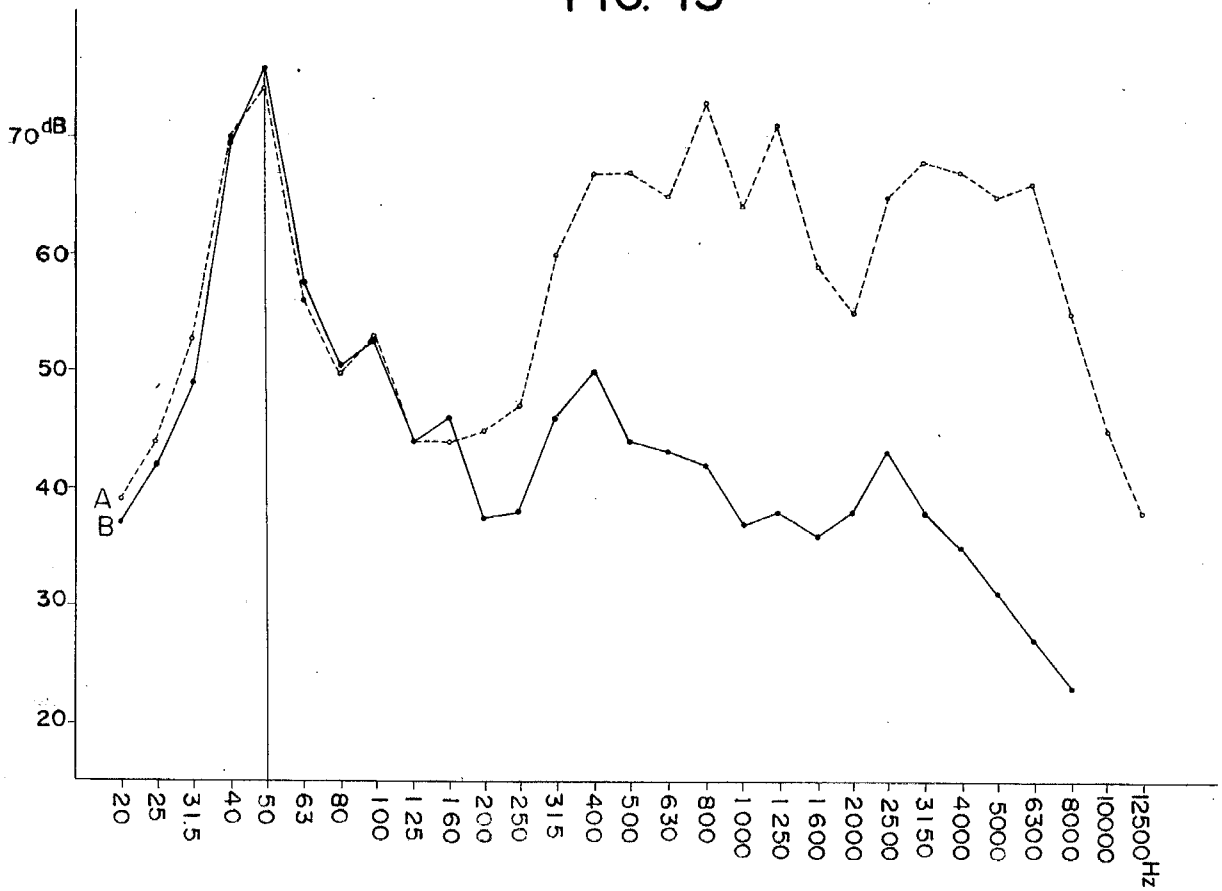
Figure 14:
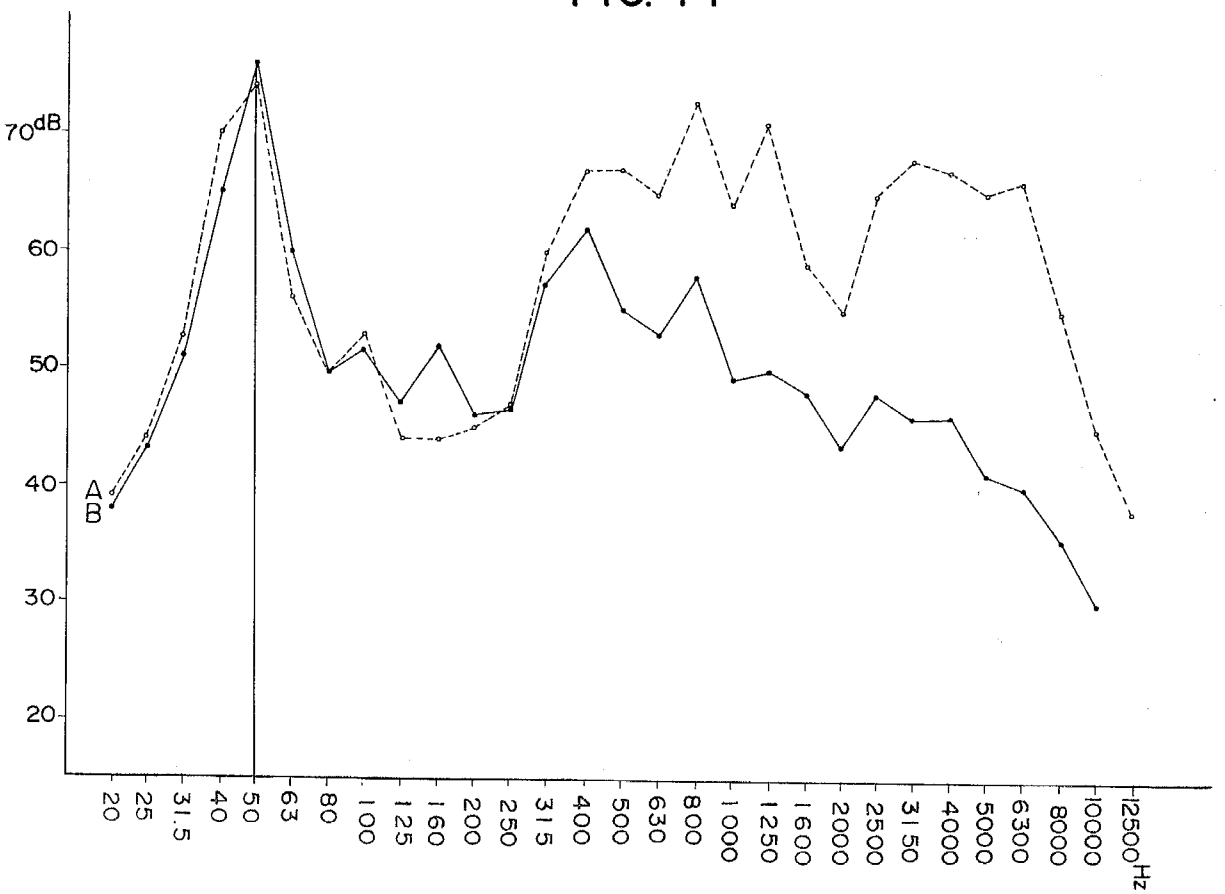
Figure 15:
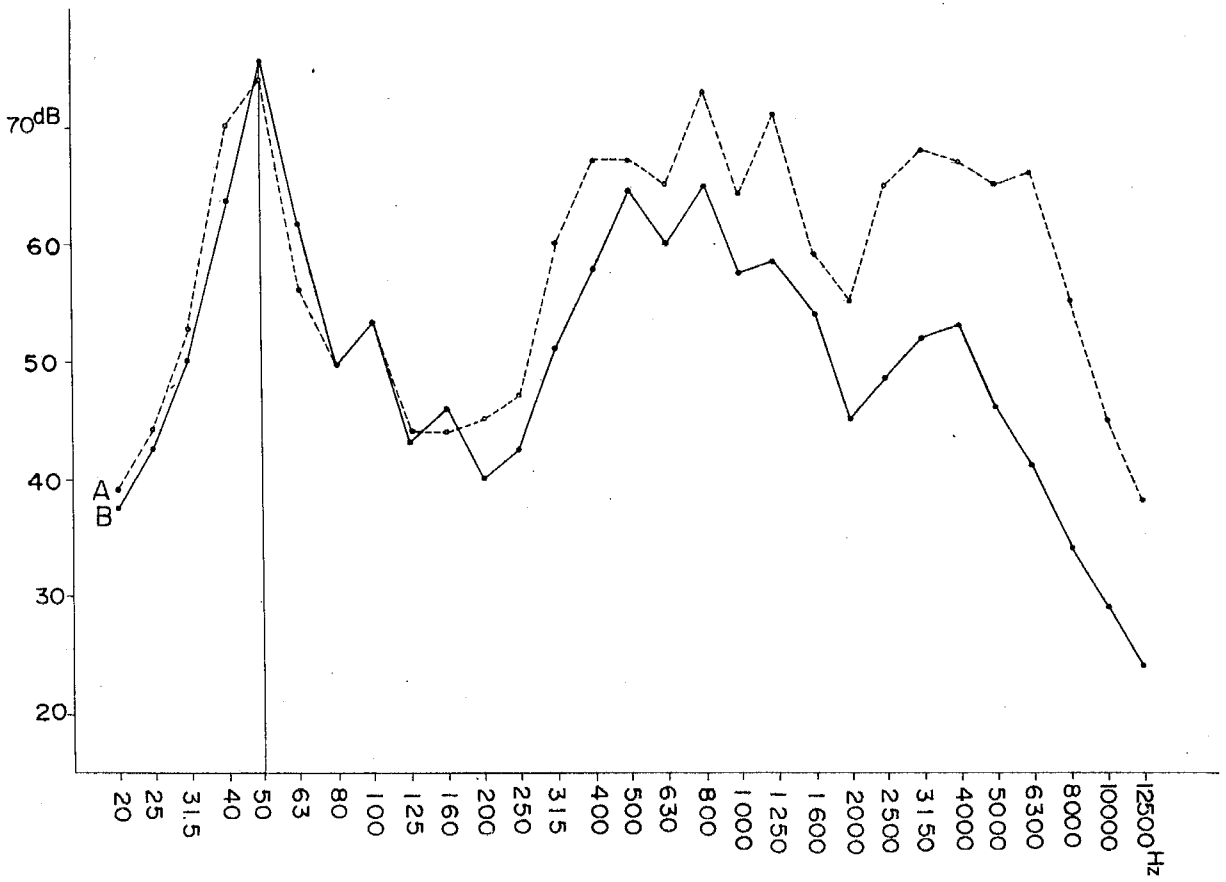

| | FIBER PIECE LENGTH (mm) | FIBER PIECE THICKNESS (denier) |
|---|---|---|
| FIG. 9 | 3.0 | 30 |
| FIG. 10 | 1.5 | 14 |
| FIG. 11 | 1.5 | 8 |
| FIG. 12 | 1.0 | 6 |
| FIG. 13 | 1.0 | 3 |
| FIG. 14 | 0.3 | 3 |
| FIG. 15 | 0.3 | 1.5 |

The graphs show that the longer and thicker the fiber pieces are, the lower the noise level is at each frequency.

It is also reported that the discomforting clattering sound was not generated. This is supported by the graph showing that the noise level of a sample having fibers coated thereon is remarkably lower than that of a sample including the conventional connectors within the range 250 to 8,000 Hz.

It will be clear from the foregoing description that connectors of the present invention are instrumental in preventing generation of noise liable to be caused by vibration of the vehicle body in which the connectors are used. Particularly, the discomforting buzzing sound or clattering sound are entirely eliminated by replacing the conventional connectors with the connectors according to the present invention.

It will be understood that modifications may be made without departing from the scope of the appended claims.

What is claimed is:

1. A connector structure comprising a female connector and a male connector, said female connector having a cavity and said male connector having a projecting portion slidably received within said cavity and retained therein to form a unitary connector structure, the exposed outer surfaces of said female connector and said male connector being coated with a thin dried adhesive film having embedded therein and projecting therefrom a multitude of fibers having a length of from 0.3 to 3 mm and having a thickness of from 1.5 to 30 denier, said fibers being selected from the group consisting of nylon, rayon and cotton, said fibers forming an integral uniform noise-reducing layer on the exterior surface of said connector structure.

2. A connector structure according to claim 1 in which at least one of (1) the internal surface of said cavity and (2) the external surface of said projecting portion, is coated with a second thin dried adhesive film having embedded therein and projecting therefrom a multitude of said fibers to form an integral uniform noise-reducing layer between the internal surface of said cavity and the external surface of said projecting portion.

3. A connector structure for use in connecting two cables comprising a female connector and a male connector, said female connector having a cavity and said male connector having a projecting portion slidably received within said cavity and retained therein to form a unitary connector structure, at least one of (1) the internal surfaces of said cavity and (2) the external surfaces of said projecting portion being coated with a first thin dried adhesive film having embedded therein and projecting therefrom a multitude of fibers, said fibers forming an integral uniform noise-reducing layer between the internal surface of said cavity and the external surface of said projecting portion, the exposed outer surfaces of said female connector and said male connector being coated with a second thin dried adhesive film having embedded therein and projecting therefrom a multitude of said fibers to form an integral uniform noise-reducing layer on the exterior surface of said connector structure.

4. A connector structure according to claim 3, in which said fibers are selected from the group consisting of nylon, rayon and cotton.

5. A connector structure according to claim 4, in which said fibers have a length of from 0.3 to 3 mm and have a thickness of from 1.5 to 30 denier.

6. A connector structure according to claim 3 in which said female connector is an elongated hollow member and wherein said cavity opens through one longitudinal end thereof, said male connector is an elongated hollow member, said projecting portion of said male connector projecting longitudinally into said cavity, said projecting portion having a circumferential wall whose shape is complementary to and is of substantially the same size as said cavity so that said projecting portion is snugly slidably telescoped in said cavity with said internal and external surfaces being located closely adjacent each other and separated only by said noise-reducing layer.

7. A connector structure according to claim 6 in which said cavity and said circumferential wall of said projecting portion are of corresponding out-of-round configuration in transverse cross-section, said cavity having a recess in the wall thereof at a position spaced longitudinally from said one longitudinal end thereof, said projecting portion having a lock element projecting outwardly from the circumferential wall thereof and received in said recess for retaining said projecting portion in said cavity.

8. A connector structure according to claim 1 in which said female connector is an elongated hollow member and wherein said cavity opens through one longitudinal end thereof, said male connector is an elongated hollow member, said projecting portion of said male connector projecting longitudinally into said cavity, said projecting portion having a circumferential wall whose shape is complementary to and is of substantially the same size as said cavity so that said projecting portion is snugly slidably telescoped in said cavity with said internal and external surfaces being located closely adjacent each other.

9. A connector structure according to claim 8 in which said cavity and said circumferential wall of said projecting portion are of corresponding out-of-round configuration in transverse cross-section, said cavity having a recess in the wall thereof at a position spaced longitudinally from said one longitudinal end thereof, said projecting portion having a lock element projecting outwardly from the circumferential wall thereof and received in said recess for retaining said projecting portion in said cavity.

* * * * *